United States Patent [19]

Casson et al.

[11] 3,997,414

[45] Dec. 14, 1976

[54] GAS CONCENTRATED AND COOLED ELECTROLYTIC CELL

[75] Inventors: Harold Vincent Casson, Napanee, Canada; Richard Eric Loftfield, Chardon, Ohio; Bruno Kindl, Kingston, Canada

[73] Assignee: Huron Chemicals Limited, Kingston, Canada

[22] Filed: May 5, 1975

[21] Appl. No.: 574,391

[52] U.S. Cl. ..... 204/95; 204/270; 204/278

[51] Int. Cl.[2] ..... C25B 1/24; C25B 1/26; C25D 21/04

[58] Field of Search ..... 204/277, 278, 270, 275, 204/237, 95

[56] References Cited

UNITED STATES PATENTS

| | | | |
|---|---|---|---|
| 1,085,742 | 2/1914 | Leffel | 204/278 |
| 3,324,024 | 6/1967 | Portman | 204/278 |
| 3,766,044 | 10/1973 | Westerlund | 204/270 |
| 3,819,503 | 6/1974 | Casson et al. | 204/278 |

*Primary Examiner*—T. M. Tufariello

*Attorney, Agent, or Firm*—Stevens, Davis, Miller & Mosher

[57] ABSTRACT

An electrolytic cell is provided that is particularly suitable for the production of oxy -halogen compounds such as sodium chlorate by electrolysis of an alkali metal halide such as sodium chloride. A cell chamber is provided containing an electrode assembly and is connected for the circulation of electrolytic solution to a cooling and concentrating chamber. Gas communication between the cell chamber and the cooling and concentration chamber is substantially avoided. Gas evolved during the electrolysis is separately removed from the cell chamber and is preferably scrubbed. Gas such as air is swept through the cooling and concentration chamber so as to provide at least part of the cooling requirements for removing the heat generated during the electrolysis and to evaporate, thereby concentrating the electrolytic solution. This takes advantage of the sensible heat of the electrolytic solution for the evaporation of such solution.

12 Claims, 5 Drawing Figures

GAS CONCENTRATED AND COOLED ELECTROLYTIC CELL

BACKGROUND OF THE INVENTION

Present systems for producing products such as sodium chlorate by the electrolysis of sodium chloride solutions may generally be classified in the following groups:

a. Bipolar cells placed in large tanks.

b. Small monopolar cells.

Both of these systems have inherent disabilities. The bipolar cells which are situated in a large tank of electrolyte, are generally swept with air to dilute the evolved hydrogen below the explosive limit, generally 50 volumes of air for each volume of hydrogen. This combined air-hydrogen stream contains small particles of sodium chloride and sodium chlorate, and because of the large volume involved it is very difficult to effectively scrub out these particles. Because of the configuration of the cells it is difficult to direct the air stream to obtain adequate contact between the air and the solution and to achieve sufficient evaporation which would result in cooling and concentration of the solution. For this reason large quantities of cooling water are needed and large expensive heat transfer surfaces are involved. Due to insufficient concentration of the solution this must be sent through an evaporator for further concentration prior to use in any of the standard chlorine dioxide generators. This requires more energy usually in the form of steam.

The small monopolar cells also have their inherent difficulties. Each small cell must have either its individual acid and electrolyte feed and individual cooling or the electrolyte from many cells must be circulated to a large reaction tank and heat exchanger. This, of course, requires extra equipment and energy for pumping. In this procedure no air is swept across the electrolyte to cause evaporation, cooling and concentration, therefore this system also requires large quantities of cooling water and large heat transfer surfaces and in addition the solution requires further concentration before it is suitable for chlorine dioxide generator feed.

SUMMARY OF THE INVENTION

An object of this invention is to provide an electrolytic cell and a method of operating such cell that results in a low consumption of total energy.

A further object of this invention is to utilize the heat of the electrolyte developed during electrolysis in its evaporation and concentration.

Another object is to cool the electrolyte by the same means used to evaporate and concentrate the electrolyte, thereby reducing the need for auxiliary cooling.

Another object is to minimize the quantity of gas that should be scrubbed to remove particles of solid and liquid product.

A further object in its application to a sodium chlorate plant is to provide an electrolyte that has been evaporated and concentrated so as to be suitable as a feed for chlorine dioxide generator.

Another object is to achieve the foregoing while avoiding the danger of an explosion.

These and other objects and advantages of the invention are in summary, achieved by providing a cell chamber containing an electrode assembly of anodes and cathodes to electrolyze an electrolytic solution to generate a dissolved product and a gas. This gas is separately removed from the cell chamber. A cooling and concentration chamber, which, as known in this art, acts also as a reaction chamber where hypoxyhalides convert to halates, is also provided and this communicates with the cell chamber to allow for the free or forced circulation of electrolytic solution. However, there is a substantial seal against the passage of gas from one chamber to the other. A gas sweep is directed through the cooling and concentration chamber to cool the electrolyte and evaporate part of the electrolyte so as to concentrate it.

This results in the utilization of the sensible heat of the electrolyte in its evaporation and concentration and at the same time the gas sweep cools the electrolyte so as to reduce or even eliminate the need for auxiliary cooling. The gas that is evolved in the cell chamber is separate as it emerges from the cell chamber and it is therefore convenient to pass it through a de-mister for scrubbing entrained liquids and solids. The volume of gas to which this treatment should be applied is far less that would be the case if the gas has been combined with the gas used for cooling and concentration. The separation of the chambers with respect to interchange of gas is important to avoid the danger of an explosion, particularly where the gas evolved during the electrolysis is hydrogen and the gas sweep through the cooling and concentration chamber utilizes air. However, where the gas sweep is sufficient in volume to dilute the hydrogen below the explosive limit the hydrogen that has passed through the de-mister can subsequently be combined with the air stream leaving the cooling and concentration cell.

Should the gas sweep be insufficient in volume to dilute $H_2$ below the explosive limit, a suitable air or gas intake can be kept open just before the mixing zone where the two streams of gases are combined. The proper ratio of $H_2$ to air can then be maintained at any gas sweep rate over the cooling and concentration cell.

DESCRIPTION OF THE PREFERRED EMBODIMENTS

Figure 1:
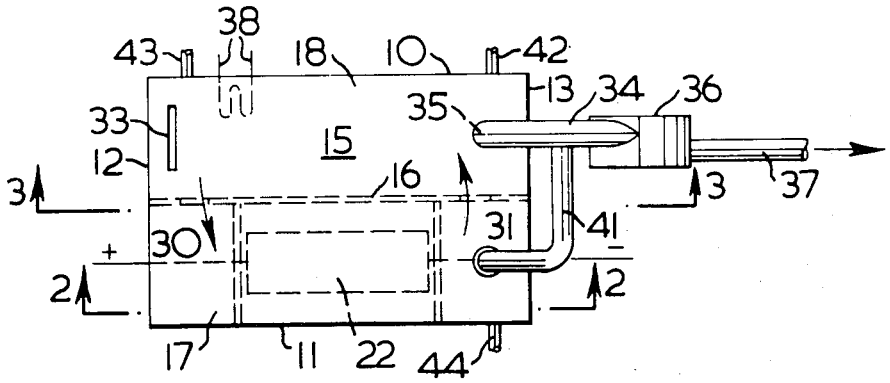
FIG. 1 is a plan view of an electrolytic cell in accordance with one embodiment of this invention.
Figure 2:
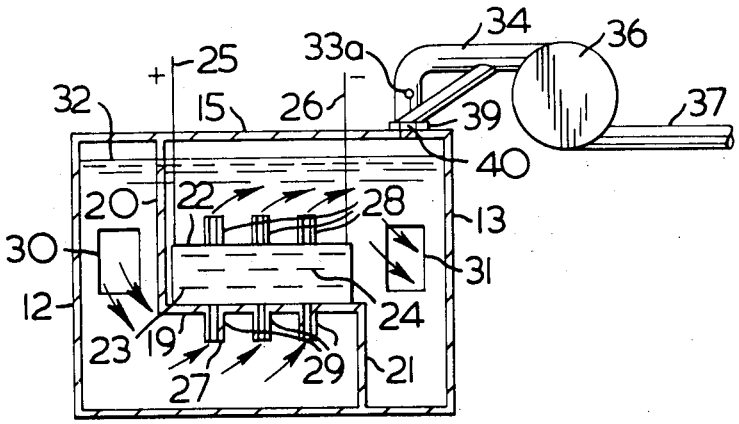
FIG. 2 is an elevation view partly in section along the line 2—2 of FIG. 1.
Figure 3:
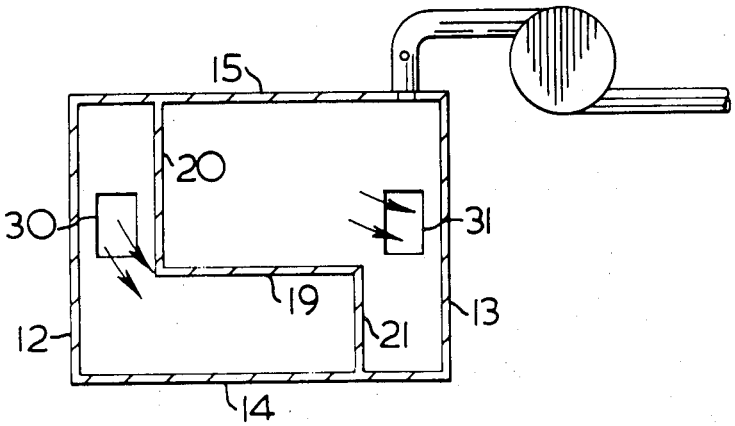
FIG. 3 is an elevation view partly in section along the line 3—3 of FIG. 1.

In the embodiment illustrated in FIGS. 1 to 3 inclusive there is a rectangular container formed by side walls 10 and 11, end walls 12 and 13, base 14 and top 15. This container is divided by longitudinally extending partition wall 16 into a cell chamber generally indicated by the numeral 17 and a cooling and concentration chamber generally indicated by the numeral 18. Partition wall 16 extends the full length and height of the container so as substantially to prevent gas from passing between the cell chamber 17 and the cooling and concentration chamber 18.

Cell chamber 17 has within it a platform 19 which extends between side wall 11 and partition wall 16 and is connected at one end to dividing wall 20. Dividing wall 20 also extends between side wall 11 and partition wall 16 and is connected to top 15. At the other end of platform 19 dividing wall 21 extends downwardly from platform 19 to base 14 and extends also from side wall 11 to partition wall 16. Dividing walls 20 and 21 together with platform 19 provide therefore a stepped construction separating the cell chamber into two compartments.

Mounted on platform 19 is a container 22 within which is an electrode assembly including anodes 23 and cathodes 24 which are interleaved. Bars 25 and 26 provide electrical connections for the anodes and cathodes respectively to enable direct current to be supplied for the purpose of electrolysis. Inlet ports 27 and outlet ports 28 communicate with the interior of container 22 to permit an electrolyte to flow into and out from container 22. Inlet ports 27 pass through apertures 29 to the compartment of the cell chamber that is below the platform, whereas ports 28 communicate with the other compartment of the cell chamber. The structure of container 22 and the electrode assemblies within it is described in more detail in U.S. Pat. No. 3,819,503 for an invention entitled "Electrolytic Cell for the Production of Oxyhalogens" issued June 25, 1974 for an invention of Harold V. Casson, James S. Bennett and Richard E. Loftfield. Ports 30 and 31 provide communication through partition wall 16 between cell chamber 17 and cooling and concentration chamber 18. Both of these ports 30 and 31 are below the level 32 of the electrolyte so as to avoid the passage of gas between the cell chamber and the cooling and concentration chamber. For this purpose it is necessary only that the port be submerged at one side as this will be sufficient to substantially block the passage of gas. It will, of course, be appreciated in this connection that the level of the electrolyte in the cell chamber will be slightly higher than that in the cooling and evaporation chamber due to the decrease in density resulting from the presence of evolving hydrogen.

An inlet port 33 for the admission of air is provided in top 15 at one end of the cooling and concentration chamber 18. At the other end there is a duct 34 communicating with the interior of the cooling and concentration chamber through opening 35 in top 15. An auxiliary opening 33*a* is located near to top 15 on the exhaust ducting 34 as a secondary admission of air to be mixed with $H_2$. Suction fan 36 withdraws air through port 35 and duct 34 and discharges it through duct 37. Air is thus caused to sweep across the surface of the electrolyte in cooling and concentration chamber 18 at a high velocity. It is preferred that ports 33 and 35 be arranged as illustrated in FIG. 1 to sweep the air countercurrent to the flow of the electrolyte. If necessary, auxiliary cooling coils 38 may be provided in the cooling and concentration chamber 18.

A scrubbing device such as de-mister 39 to remove entrained solids and droplets of liquid is located above an outlet port 40 in cell chamber 17 to treat the hydrogen evolved in the cell chamber. The hydrogen then passes through conduit 41 which connects with duct 34 where the hydrogen will be diluted below its explosive limit by the large volume of air swept across the electrolyte. The hydrogen is thus scrubbed before it is diluted with air which means that a smaller volume of gas requires treatment. Furthermore, as hydrogen is about 7% as dense as air the de-mister is more efficient than if air were mixed with hydrogen before de-misting.

The cell is provided with a feed solution inlet 42 which is illustrated as communicating with the cooling and concentration chamber 18 but which could be located at either chamber. There is also an acid feed line 43 for the purpose of adding sufficient acid to maintain a constant pH. The product of the electrolysis is removed through drain 44.

In operation the electrolytic solution circulates in the direction shown by the arrows in FIGS. 1 and 2 due to the gas lift effect of the hydrogen evolved in the electrolysis. The heat generated during electrolysis is removed by the combined effect of the air sweep passing countercurrent to the direction of flow of the electrolyte as described above, together with the auxiliary cooling coils 38. At the same time the air causes evaporation and consequent concentration of the electrolytic solution.

Figure 4:
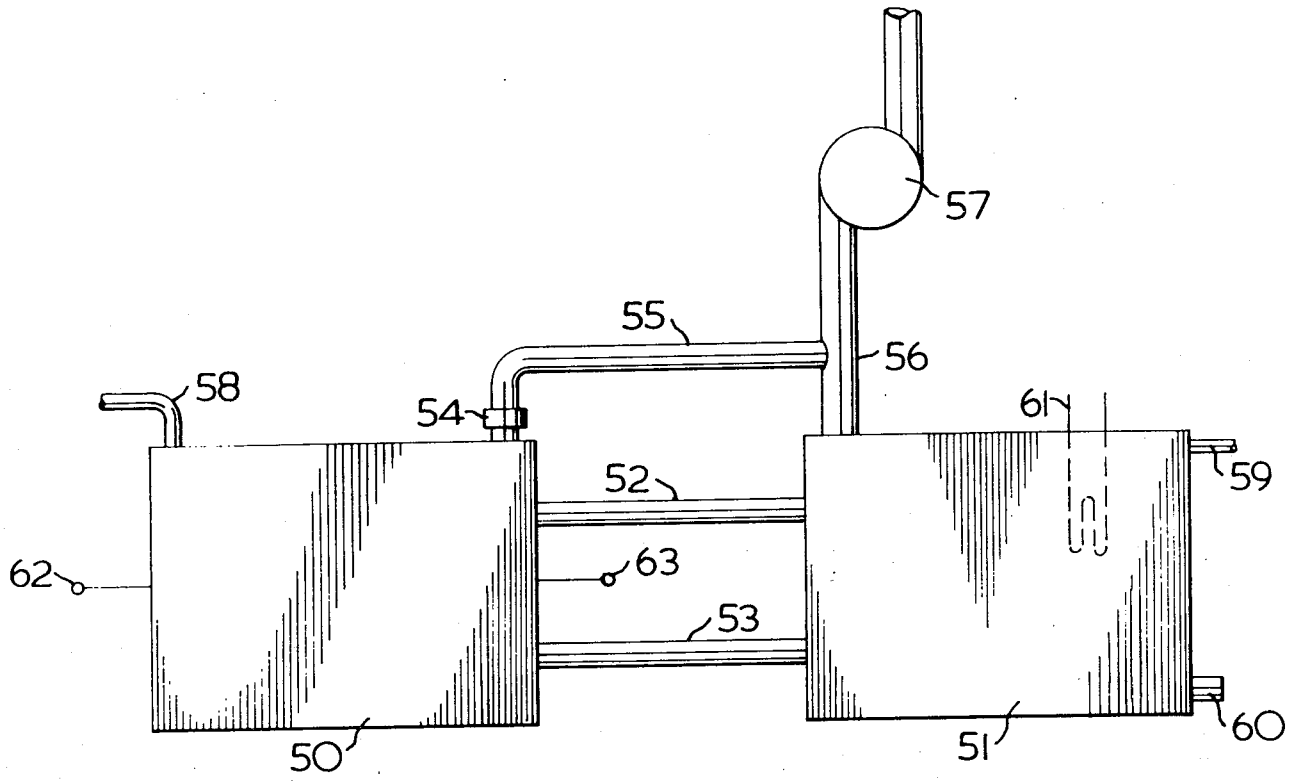
FIG. 4 is an elevation view illustrating an alternative embodiment of this invention.

FIG. 4 illustrates a further embodiment of the invention in which the cell chamber 50 is entirely separate from cooling and concentration chamber 51. The electrolyte flows through line 52 from chamber 50 to 51 and returns through line 53. The hydrogen gas generated in chamber 50 is passed through de-mister 54 and conduit 55 which leads into conduit 56. Conduit 56 receives air driven from chamber 51 by blower 57. The feed inlet line is indicated at 58, the acid feed line at 59 and the drain at 60. Auxiliary cooling coils are indicated at 61. The electrodes contained in chamber 50 may, for example, be of the type described in U.S. Pat. No. 3,791,947 entitled "Electrolytic Cell Assemblies and Methods of Chemical Production" issued Feb. 12, 1974 for an invention of Richard E. Loftfield. The anode and cathode terminals are indicated in FIG. 4 at 62 and 63 respectively.

Figure 5:
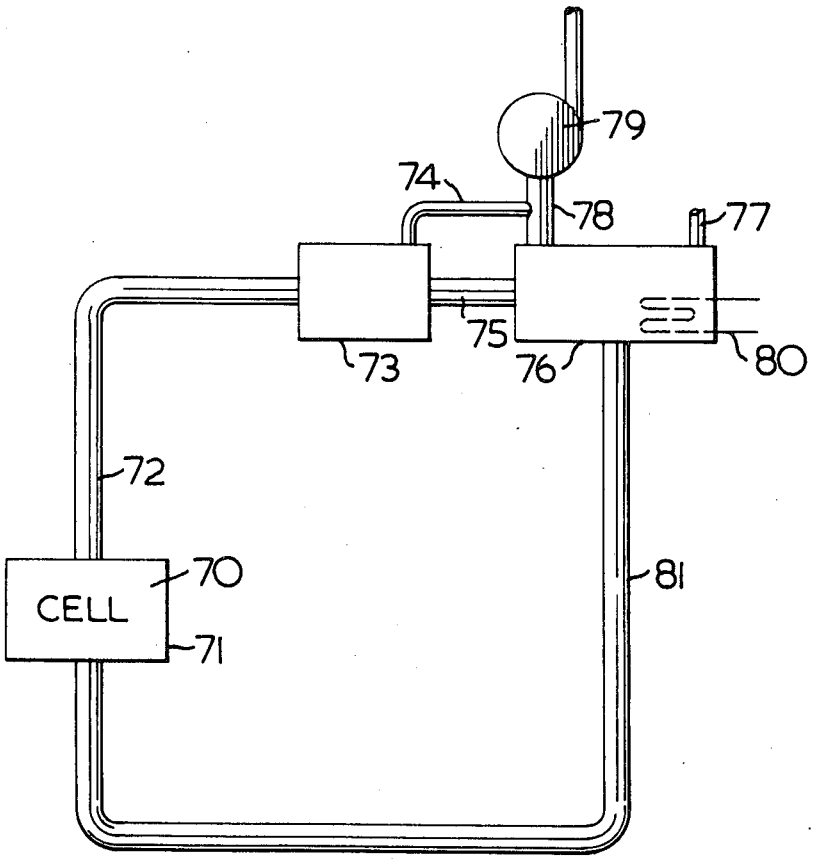
FIG. 5 is a schematic elevation view illustrating a further embodiment of this invention.

FIG. 5 illustrates the application of the principles of this invention to a cell of the type illustrated in Canadian Pat. No. 850,080 in the name of Jacques Fleck and entitled "Electrolytic Manufacture of Alkaline Chlorates" issued Aug. 25, 1970. In this embodiment a monopolar cell 70 is contained in compartment 71 which communicates through line 72 with a hydrogen separator 73 from which hydrogen is removed through line 74. The electrolyte circulates from hydrogen separator 73 through line 75 into a cooling and concentration chamber 76. Air enters chamber 76 through port 77 and is withdrawn through conduit 78 by suction fan 79. Conduit 74 connects with conduit 78 so that the hydrogen will be mixed and diluted with air. Auxiliary cooling coils 80 may, if desired, be provided in chamber 76. Lead line 81 returns the electrolyte to cell 70. In this embodiment, therefore, the cell and hydrogen separator are physically separated but they combine to provide a cell chamber from which hydrogen is released.

This invention is further illustrated by the following examples:

EXAMPLE 1

The equipment described in FIG. 1 is operated at 10,000 amperes through a 12 cell bipolar unit to make feed solution for an R-2 chlorine dioxide generator. The term R-2 is used in the art to refer to a solution that contains 340 gpl $NaClO_3$ and 200 gpl $NaCl_2$. Sodium chloride feed solution is 305 gpl NaCl.

The electrolytic cell operates at 93% current efficiency. The apparatus containing both the electrolysis and cooling chambers has a capacity of 18,000 liters. Electrolysis proceeds per overall equation $$NaCl + 3H_2O \xrightarrow{6e} NaClO_3 + 3\ H_2$$

To obtain 340 gpl liters $NaClO_3$:

$$\frac{18{,}000 \times 340}{12 \times 10{,}000 \times \frac{106.5}{6} \times \frac{1}{26.8} \times .93} = 82.8 \text{ hours of operation}$$

During 82.8 hours the following is produced or transformed:

$$NaClO_3\ 82.8 \times 12 \times 10{,}000 \times \frac{106.5}{6} \times \frac{1}{26.8} \times .93 = 6{,}120{,}000 \text{ g } NaClO_3$$

$$NaCl\ 82.8 \times 12 \times 10{,}000 \times \frac{58.5}{26.8 \times 6} \times .93 = 3{,}361{,}000 \text{ g NaCl}$$

$$H_2O \text{ consumed } 82.8 \times 12 \times 10{,}000 \times \frac{3 \times 18}{26.8 \times 6} \times .93 = 3{,}103{,}000 \text{ g } H_2O$$

Vol. loss due to water of reaction (data indicates loss of 0.51 ml per gram of $$H_2O \text{ consumed} = \frac{3{,}103{,}000}{1{,}000} \times 0.51 = 1{,}583 \text{ liters}$$

Water loss in $H_2$ at 65° C, vapour pressure over the solution = 162 mm Hg $$82.8 \times 12 \times 10{,}000 \times \frac{1}{26.8 \times 2} \times \frac{162}{598} \times 18 = 903{,}926 \text{ grams} = 904 \text{ liters}$$

Total vol. loss 1,583 + 904 = 2,502 liters.

This loss would be made up by the addition of 305 gpl NaCl brine and this would add NaCl to the system - 305 × 2,502 = 755,000 grams.

| | |
|---|---|
| Initial grams NaCl 305 × 18,000 | 5,490,000 |
| Gram NaCl lost in reaction | 3,361,000 |
| | 2,129,000 |
| Grams NaCl added in make up solution | 755,000 |
| Total grams left in reactor | 2,881,000 |
| Divide by 18,000 = 160.1 grams per liter. | |

Therefore 200 − 160.1 = 39.9 gpl must be added to bring this solution to a concentration that can be used in an R-2 sodium chlorate reactor. This could be done by adding high purity solid sodium chloride, but is generally done by the addition of the available high purity sodium chloride solution (305 gpl).

The amount added would be $\frac{18{,}000 \times 39.9}{305} = 2{,}355$ liters.

The water would then have to be evaporated, the quantity would be 2,355 × .865g/l = 2,037 liters.

In the teaching of our invention this evaporation is accomplished with an air sweep over the liquid in the cooling chamber. The product concentration can be regulated by the quantity of air used.

The cooling action is accomplished by evaporation and the heating of the air stream, approximately 50% due to each factor. The total heat removed is therefore 2,037 liters × 2.2 = 4,487 pounds. 4,487 × 970 × 2 = 8,704,000 BTU or ÷ 82.8 = 105,130 BTU/hr.

This is approximately 16% of the total cooling requirement and is accomplished without any added energy requirement since the air blower would be required for dilution of air. This also allows for a 16% reduction in heat exchange area.

EXAMPLE 1-A

In the practice prior to our invention the NaCl brine would be added after the solution was placed in a receiving tank. It is obvious that the solution would then have to be brought to boiling point requiring heat, then the 2,037 liters of $H_2O$ would have to be evaporated, and the solution once again cooled to approximately 60° C so that it can be handled in available equipment. The overall process would require approximately 10,000,000 BTU/batch above that required in the invented procedure.

EXAMPLE 2

An installation similar to that shown in FIG. 1 was operated at 9400 Amp through 12 cells in the electrolysis chamber. 1269 cu ft/min. of air at 82° F dry bulb temperature and 69° F wet bulb or 54% rel. humidity were swept over the cooling and concentration chamber. At the outlet dry bulb temperature was 88½° F and 75½° F wet bulb or 55% rel. humidity. The solution temperature was 113° F.

| | |
|---|---|
| The total water pick up in the air stream was | 45.6 lb/hr |
| The water in the $H_2$ stream was | 7.8 lb/hr |
| The net pick up of water in the cooling air was | 37.8 lb/hr |
| Cooling action accomplished by evaporation = 37.8 × 970= | 36660 BTU/hr |
| Cooling action accomplished by air stream heating = 1269 cu ft/min | 5710 lb/hr |
| | 5710 × 0.23 × × (88 ½–82) = 8900 BTU/hr |
| Cooling due to evaporation with air = | 45560 BTU/hr |
| Total cooling requirement = | 616000 BTU/hr |
| | 7.5% cooling |

-continued

| | | furnished |
|---|---|---|

EXAMPLE 3

Same cell as example No. 2

Air flow 1300 cu. ft./min 30° C in 41° C out (86° F in 106° F out). Since we did not measure wet bulb - assume 60% relative humidity.

| | In | Out |
|---|---|---|
| Temperature ° F | 86 | 106 |
| Relative Humidity | 60% | 60% |
| BTU/No. dry air (from Psychrometric chart) | 37 | 56.5 |
| Grains $H_2O$/No. dry air (from Psychrometric & chart) | 110 | 210 |
| & Cu.Ft./No. dry AIR (from Psychrometric & chart) | 14.1 | 14.9 |

$$\frac{1300}{14.9} \times 60 \times \frac{100}{7000} = 74.8 \text{ lbs./hr } H_2O \text{ evaporated.}$$

$$\frac{1300}{14.9} \times 60 \times (56.5 - 37) = 102{,}080 \text{ BTU/hr}$$

$$\frac{102{,}080}{616{,}000} = 16\% \text{ of heat load}$$

I claim:

1. An electrolytic cell comprising a cell chamber adapted to contain an electrolytic solution and having an electrode assembly of anodes and cathodes adapted to electrolyze said electrolytic solution to generate a dissolved product and a gas, means for removing said gas from said cell chamber, a cooling and concentration chamber, at least one conduit communicating between said cell chamber and said cooling, evaporation and concentration chamber for the circulation of electrolytic solution from the cell chamber to the cooling and concentration chamber, at least one conduit communicating between said cooling and concentration chamber and said cell chamber for the circulation of electrolytic solution from the cooling and concentration chamber to the cell chamber, each of said conduits being below the level of the electrolytic solution in at least one of said chambers to avoid the passage of gas between the chambers and said chambers being substantially sealed against the passage of gas from one to the other, inlet and outlet means for producing a gas sweep through the cooling and concentration chamber across the surface of the electrolyte in such chamber to cool the electrolyte and evaporate part of said electrolyte so as to concentrate it, means for introducing fresh electrolytic solution into said electrolytic cell and means for removing solution containing the dissolved product.

2. An electrolytic cell comprising a cell chamber adapted to contain an electrolytic solution and having an electrode assembly of anodes and cathodes adapted to electrolyze said electrolytic solution to generate a dissolved product and a gas, means for removing said gas from said cell chamber, a cooling and concentration chamber at least one conduit communicating between said cell chamber and said cooling, evaporation and concentration chamber for the circulation of electrolytic solution from the cooling and concentration chamber to the cell chamber, each of said conduits being below the level of the electrolytic solution in at least one of said chambers to avoid the passage of gas between the chambers and said chambers being substantially sealed against the passage of gas from one to the other, inlet and outlet means for producing a gas sweep through the cooling and concentration chamber to cool the electrolyte and evaporate part of said electrolyte so as to concentrate it, a demister for scrubbing said gas from the cell chamber and means for combining the gas that has been scrubbed by the de-mister with the gas passing through the gas outlet means of the gas sweep chamber, means for introducing fresh electrolytic solution into said electrolytic cell and means for removing solution containing the dissolved product.

3. An electrolytic cell as in claim 2 in which the electrolytic solution comprises sodium chloride, the dissolved product is sodium chlorate, the gas evolved in the cell chamber is hydrogen and in which the gas sweep is air in an amount sufficient to dilute the hydrogen below its explosive limit.

4. An electrolytic cell as in Claim 1 in which said inlet and outlet means are arranged at opposite ends of the cooling and concentration chamber to produce a gas sweep that passes across substantially the entire surface of the electrolytic solution in a direction countercurrent to the direction of movement of the electrolytic solution in the cooling and concentration chamber.

5. An electrolytic cell as in claim 1 in which the cell chamber is divided into a first and second compartment and in which the electrode assembly is contained within a container having an inlet port communicating with said first compartment and an outlet port communicating with said second compartment and in which the conduit communicating between the cooling and concentration chamber and the cell chamber leads into one of said compartments and the conduit communicating between said cell chamber and said cooling concentration chamber leads out of the second of said compartments.

6. An electrolytic cell as in claim 5 in which the cell chamber is divided into a first and second compartment by a platform for supporting the container for the electrodes and an upright position wall extending from the platform to the top of the cell at one end of the platform and a partition wall extending from the other end of the platform to the bottom of the cell to provide a stepped structure in which the inlet ports to the container for the electrodes pass through the platform to permit a flow of electrolyte from said one compartment upwardly through the electrode container to the second compartment.

7. An electrolytic cell as in claim 1 in which the cell chamber comprises a compartment containing the electrodes and a separate hydrogen separation compartment and means communicating between said cell chamber containing compartment and said hydrogen separation compartment.

8. A process for the electrolysis of an electrolytic solution that releases at least one gaseous product at an electrode surface on the application of an electrolyzing current which process consists essentially of:

a. providing a cell chamber containing an electrode assembly of anodes and cathodes;

b. providing a cooling and concentrating chamber;

c. providing communicating means between said cell chamber and cooling and concentration chamber permitting the circulation of electrolyte between said chambers while not permitting the circulation of gas;
d. introducing said electrolytic solution into one of said chambers;
e. passing a direct electrolyzing current between the anode and cathode;
f. removing said gaseous product from said cell chamber;
g. providing a gas sweep across the surface of the electrolytic solution in the cooling and concentration chamber to maintain the electrolytic solution at a desired concentration and cooling said electrolytic solution;
h. discharging electrolyzed solution from one of said chambers.

9. A process as in claim 8 in which said gas sweep is directed across substantially the entire surface of the electrolytic solution in the cooling and concentration chamber in a direction countercurrent to the flow of electrolytic solution in the cooling and concentration chamber.

10. A process as in claim 8 in which the gaseous product removed from said cell chamber is scrubbed and then combined with the gas from the gas sweep.

11. A process as in claim 10 in which said gaseous product is hydrogen in which the gas used in the gas sweep is air and in which the volume of the air used in the gas sweep is sufficient to dilute the hydrogen below its explosive limit.

12. A process as in claim 11 in which the electrolytic solution comprises sodium chloride and the electrolyzed solution comprises sodium chlorate.

* * * * *